US008418663B2

(12) United States Patent
Oprea

(10) Patent No.: US 8,418,663 B2
(45) Date of Patent: Apr. 16, 2013

(54) CAM ACTUATION MECHANISM WITH APPLICATION TO A VARIABLE-COMPRESSION INTERNAL-COMBUSTION ENGINE

(76) Inventor: Radu Oprea, Bothell, WA (US)

( * ) Notice: Subject to any disclaimer, the term of this patent is extended or adjusted under 35 U.S.C. 154(b) by 409 days.

(21) Appl. No.: 12/722,215

(22) Filed: Mar. 11, 2010

(65) Prior Publication Data

US 2010/0242919 A1 Sep. 30, 2010

Related U.S. Application Data

(60) Provisional application No. 61/163,032, filed on Mar. 24, 2009.

(51) Int. Cl.
*F02D 15/04* (2006.01)
*F16H 53/02* (2006.01)

(52) U.S. Cl.
USPC ..... 123/48 D; 123/48 R; 74/567

(58) Field of Classification Search ..... 123/48 AA, 123/78 AA, 48 D, 48 B, 48 A, 78 D, 78 BA, 123/406.29, 193.6, 78 R, 90.15, 188.4, 48 R
See application file for complete search history.

(56) References Cited

U.S. PATENT DOCUMENTS

| | | | | | |
|---|---|---|---|---|---|
| 2,573,301 | A | * | 10/1951 | Berlyn | 123/188.4 |
| 4,395,978 | A | * | 8/1983 | Boyesen | 123/73 R |
| 4,516,537 | A | | 5/1985 | Nakahara et al. | |
| 4,860,711 | A | | 8/1989 | Morikawa | |
| 4,987,863 | A | | 1/1991 | Daly | |
| 5,193,493 | A | * | 3/1993 | Ickes | 123/48 R |
| 5,195,469 | A | * | 3/1993 | Syed | 123/48 A |
| 5,329,893 | A | | 7/1994 | Drangel et al. | |
| 5,427,063 | A | | 6/1995 | Anderson | |
| 6,427,643 | B1 | | 8/2002 | Dixon | |
| 6,516,774 | B2 | | 2/2003 | zur Loye et al. | |
| 6,708,655 | B2 | | 3/2004 | Maloney et al. | |
| 6,752,105 | B2 | | 6/2004 | Gray | |
| 6,769,392 | B2 | | 8/2004 | Lawrence et al. | |
| 6,814,064 | B2 | | 11/2004 | Cowans | |
| 6,910,454 | B2 | | 6/2005 | Sieber et al. | |
| 7,036,467 | B2 | | 5/2006 | Kassner et al. | |
| 7,036,468 | B2 | | 5/2006 | Kamiyama | |
| 7,047,917 | B2 | | 5/2006 | Akihisa et al. | |
| 7,055,469 | B2 | | 6/2006 | Lawrence et al. | |
| 7,167,789 | B1 | | 1/2007 | Froloff et al. | |
| 7,168,396 | B1 | | 1/2007 | Bulicz et al. | |
| 7,228,824 | B2 | | 6/2007 | Glugla et al. | |
| 7,258,086 | B2 | | 8/2007 | Fitzgerald | |
| 7,273,022 | B2 | | 9/2007 | Valdivia | |
| 7,278,383 | B2 | | 10/2007 | Kamiyama et al. | |
| 7,353,785 | B2 | | 4/2008 | Kondo et al. | |
| 7,360,513 | B2 | | 4/2008 | Takemura et al. | |

* cited by examiner

*Primary Examiner* — Lindsay Low

(57) ABSTRACT

A novel device for controlling the compression pressure of an internal combustion engine is disclosed.
The combustion chamber of each cylinder of the engine is divided into two virtual spaces, a gas exchange space and a control space. The intake and exhaust valves move in a plane substantially perpendicular to the cylinder centerline and open into the gas exchange space.
The position of a preferably toroidal volume control slider determines the control space volume and subsequently, the geometrical compression ratio of the engine. At least one actuation cam bidirectionally drives said control slider, by means of a slot and captive roller arrangement.
The device further comprises actuator means to rotate the cam to a predetermined angular position, as a function of engine load.
Thus, the device of the invention is capable of maintaining a constant compression pressure, under varying load, by altering the geometrical compression ratio of the engine.

4 Claims, 8 Drawing Sheets

CAM ACTUATION MECHANISM WITH APPLICATION TO A VARIABLE-COMPRESSION INTERNAL-COMBUSTION ENGINE

This application claims benefit under 37 CFR 119e to provisional application 61163032—filed on Mar. 24, 2009 by Radu Oprea.

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

REFERENCES:

| | | | |
|---|---|---|---|
| 7,360,513 | Takemura et al | April 2008 | 123/48 B |
| 7,353,785 | Takashi et al | April 2008 | 123/48 B |
| 7,278,383 | Kamiyama et al | September 2007 | 123/48 C |
| 7,273,022 | Valdivia | October 2007 | 123/48 R |
| 7,258,086 | Fitzgerald | August 2007 | 123/46 R |
| 7,228,824 | Glugla et al | June 2007 | 123/48 R |
| 7,168,396 | Bulicz et al | January 2007 | 123/27 R |
| 7,167,789 | Froloff et al | January 2007 | 701/101 |
| 7,055,469 | Lawrence et al | June 2006 | 123/48 AA |
| 7,047,917 | Akihisha et al | May 2006 | 123/48 R |
| 7,036,468 | Kamiyama et al | May 2006 | 123/78 R |
| 7,036,467 | Kassner et al | February 2006 | 123/48 B |
| 6,910,454 | Sieber et al | June 2005 | 123/182.1 |
| 6,814,064 | Cowans | November 2004 | 123/559.1 |
| 6,769,392 | Lawrence et al | August 2004 | 123/305 |
| 6,752,105 | Gray | June 2004 | 123/48 B |
| 6,708,655 | Maloney et al | March 2004 | 123/48 A |
| 6,516,774 | zur Loye et al | November 2003 | 123/299 |
| 6,427,643 | Dixon | June 2002 | 123/48 A |
| 5,427,063 | Anderson | June 1995 | 123/48 A |
| 5,329,893 | Drangel et al | July 1994 | 123/78 |
| 5,195,469 | Syed | March 1993 | 123/48 A |
| 4,987,863 | Daly | January 1991 | 123/48 AA |
| 4,860,711 | Morikawa | August 1989 | 123/48 D |
| 4,516,537 | Nakahara et al | May 1985 | 123/48 AA |

BACKGROUND OF THE INVENTION

As reduction of the greenhouse gas carbon dioxide ($CO_2$) is becoming more and more imperative, a practical way of improving the efficiency of the automobile engine is urgently needed.

It is well known that the efficiency of the Spark-Ignition (SI) engine is directly dependent on engine load. Most modern SI engines run at a fixed, preferably stoichiometric, Air/Fuel Ratio—hereinafter referred to as AFR. Output regulation is accomplished by throttling the intake duct, thereby reducing the mass flow of air, or combustible mixture. Thus, the SI engine is most efficient at full load, where throttling is absent. Its efficiency is lower at part load operation, mainly due to the following two factors of influence, working in co-operation:

1. Increase in pumping losses with throttling.
2. Reduction of the cylinder pressure, at the end of the compression stroke, hereinafter referred to as compression pressure, or Pc.

Automobile engines operate at part load for most of the time, which significantly impairs vehicle fuel economy and increases $CO_2$ emissions. Hence, improving part-load efficiency will have the largest impact on the overall fuel economy of the automotive engine.

One possible approach is to act upon the first of the two aforementioned factors of influence, i.e. throttling. Internal mixture formation systems (direct injection) have been developed, which allow the SI engine to run unthrottled, at certain speeds and loads. Engine power is controlled by varying the air-fuel ratio, much like in a Diesel engine. Unthrottled engines inherently operate over a wide AFR range, from very lean at idle and light load, to near stoichiometric at full load. Airflow is essentially constant and output regulation is achieved by modifying the fuel flow rate, and subsequently the AFR.

Emissions control technologies for the stoichiometric-burn SI engine have reached extremely high efficiency, through many decades of refinement. The mainstream emissions reduction strategy relies on Three-Way Catalytic (TWC) exhaust gas aftertreatment, which requires running with a stoichiometric AFR throughout the entire speed/load range of the engine. The stoichiometric SI engine with TWC aftertreatment has been honed into a very efficient, reliable and cost-effective solution.

In contrast, the exhaust aftertreatment techniques for the lean mixtures used by the unthrottled SI engine are relatively new and still far from the efficiency and cost effectiveness of the TWC.

The above brief overview will make it apparent that SI engine efficiency improvement by eliminating the throttle is difficult and expensive.

Manipulating the second factor of influence, i.e. compression pressure, is a well-known theoretical path to increasing SI engine efficiency, but a practical solution has yet to be developed.

Although usually referred to as Variable Compression Ratio (VCR), this approach would perhaps be more aptly called Constant Compression [Pressure] Engine, as the aim is to maintain a constant compression pressure, Pc, over the entire operating domain of the engine.

Throttling reduces intake manifold pressure, thereby reducing mass airflow to the engine. Thus, a higher degree of throttling may appear equivalent to utilizing a smaller displacement engine. The critical difference, however, is that Pc is also reduced with throttling. Indeed, if a constant Pc could be maintained, irrespective of intake manifold pressure, part-load operation would be much more similar to running a smaller engine at full load and thereby at its peak efficiency. Admittedly, the increased pumping losses will somewhat offset the theoretically constant efficiency.

Evidently, holding Pc constant means altering the geometrical compression ratio, hereinafter referred to as CR, as clearly illustrated by the equation:

$$P_c = P_a \cdot CR^{nc}$$

Where: Pa is the cylinder pressure at the beginning of the compression stroke, and nc is the polytropic coefficient of the compression process.

A most important advantage of this approach is that it fully exploits mature and cost-effective fuel metering and exhaust aftertreatment technologies, i.e. port fuel injection and TWC, respectively.

It should also be noted that an attractive method to rise engine specific output is to increase intake manifold pressure, at high load, above atmospheric. The technique, well known to those skilled in the art, is referred to as supercharging and is accomplished by using some type of air compressor, or charger. One widely used arrangement utilizes a centrifugal air compressor, driven by an exhaust-gas turbine. The aggregate turbine-compressor device is called a turbocharger and its use on an engine is often referred to as turbocharging.

The higher manifold pressure, or boost, augments mass airflow, subsequently increasing the specific output of the engine. The main limiting factor is the onset of abnormal combustion, i.e. detonation, or knock, caused by the higher compression pressure of the supercharged engine. Thus, the geometrical Compression Ratio, CR, of a supercharged engine must be lower than in a similar, but normally aspirated, powerplant. That further reduces the part-load efficiency of the supercharged engine.

The two main approaches used in the prior art to control the geometric compression ratio are:

a) Altering the piston Top Dead Centre (TDC) position in respect to the cylinder head.

b) Modifying the combustion chamber volume.

The first path relies on modified pistons or crank mechanisms, or even on cylinder heads moveable in respect to the engine block. While a few experimental engines based on this first strategy do exist (SAAB, MCE-5/Peugeot), the complexity of the solutions makes those engines difficult to mass produce at a competitive cost.

The second approach present in the prior art is modifying the geometrical compression ratio by creating a variable volume combustion chamber, or a sub-chamber within the engine combustion chamber. The volume-control device is usually a sliding piston, driven by one of many possible actuator means.

Study of the prior art reveals a number of paper solutions, all of which pose significant practical obstacles to a functionally viable implementation.

Referring now to said second approach, while the idea is, in principle, sound—and essentially obvious to one skilled in the art, there are several serious practical impediments associated with the prior art concepts, as follows:

The combustion pressure of a typical SI engine is in the 100 bar range, which imparts kN level forces to the sliding piston, in a high-gradient, pulsating manner. The high-pressure pulses alternate with low-pressure ones, occurring during the intake strokes of the engine. The rapidly fluctuating cylinder pressure will cause the sliding piston to oscillate, thereby uncontrollably altering the effective compression ratio of the engine. Rigid and bi-directional locking means must be included in the piston actuation mechanism, to prevent the sliding piston from oscillating.

If a cam is used to directly drive the sliding piston, the high-pressure forces acting on the piston also create a substantial frictional load at the point of contact between piston and cam.

Generally, prior art work does not provide an explicit solution for keeping the sliding piston and its actuator in permanent contact. An exception is U.S. Pat. No. 5,195,469 (Syed), wherein the piston is still unidirectionally driven by a cam, but a spring is used to maintain piston-to-cam contact. However, considering the highly dynamic forces involved, a spring-loaded piston is very likely to temporarily loose contact with the actuation cam and bounce.

Moreover, during acceleration, the automotive engine often rapidly transitions from idle, i.e. highest desired CR, to full load, i.e. lowest desired CR. The transition time may be as short as 100 ms and the volume-control device must be equally fast. If the volume-control device motion lags throttle opening, Pc will reach dangerously high levels, causing violent detonation, which can quickly destroy the engine. That precludes the use of most screw type actuators proposed in prior art.

For the same reason, when a sliding piston is used, it is desirable for its stroke to be as short as possible, which means that the piston area must be as large as possible, within the load constraints on the actuation mechanism. However, the larger the sliding piston, the less room is left, in the combustion chamber, for the intake and exhaust valves.

That is especially true with modern automotive SI engines, optimized for high output at full load, which often utilize multiple intake and exhaust valves, per cylinder.

Furthermore, the valvetrain actuation mechanism, spark plugs, and possibly fuel injectors, occupy most of the space available in the cylinder head, above the combustion chamber. It is difficult to see how a sliding piston and its actuation mechanism could fit in that same space.

On the same note, some prior art arrangements show the spark plug mounted onto the sliding piston. This setup exposes the spark plug to the operating environment existing on the backside of the piston, i.e. inside the engine valve cover. Not only is that environment already rich in oil vapor, but also additional oil is highly desirable, for cooling the slider. Oil is electrically conductive, effectively short-circuiting the spark plug.

Accordingly, the main objective of this invention is to provide a practical Constant Compression Pressure Engine solution.

BRIEF SUMMARY OF THE INVENTION

The device of the invention overcomes the aforementioned disadvantages of the prior art by utilizing a novel combustion chamber arrangement, along with a new, robust, volume-control device.

The internal combustion engine being known for over a century, a well-established terminology is already in place, to describe its components and processes. Unless specifically stated otherwise, the wording of the subsequent sections of this application adheres to this established terminology, and no attempt is made to re-state commonly accepted definitions, such as engine, cylinder, combustion chamber, etc.

For clarity, one cylinder is used to describe, illustrate and exemplify the various aspects of this invention. That should by no means limit the applicability of the invention to single cylinder engines, but it should be understood that said one cylinder may be one out of the plurality of cylinders of a multi-cylinder engine.

As shown in FIG. 1, the novel arrangement of the invention divides the combustion chamber into two virtual spaces, a Gas Exchange Space, GES, and a Control Space, CS. While there is no physical demarcation between the GES and CS, each of the two said virtual spaces has its own, well-defined, role.

Another distinctively novel aspect of the invention is the fact that the intake and exhaust valves of the engine are positioned with their axes in a direction substantially perpendicular to the centerline of the cylinder. During the gas exchange processes, the intake and exhaust valves open into said gas exchange space. Physically, the GES may reside either in the engine block, or in the cylinder head.

The CS is a variable-volume space, its volume being controlled by a Volume Control Slider, VCS. This arrangement frees up the space above the combustion chamber, providing the necessary room for the VCS and its actuation mechanism.

The spark plug is preferably installed inside a machined well, and is fluidically isolated from the inside of the cylinder head cover space, in a fashion well known to those skilled in the art.

The presence of the centrally located spark plug well dictates a substantially toroidal VCS shape.

A first embodiment, illustrated by FIG. 2, has an oval VCS. This shape requires sophisticated sealing means, but provides for simpler valve actuation. An additional attribute of the oval shaped VCS is that it is inherently non-rotating. Manufacturing challenges notwithstanding, oval-shaped piston rings have been produced and are therefore known in the art.

In a second, preferred, embodiment, illustrated by FIG. 3, all the cross sections of the stepped toroidal VCS are substantially circular. This provides for simple sealing, by means of traditional piston ring type seals, well known in the art.

Both FIG. 2 and FIG. 3 show 4-valve engines, with a single spark plug per cylinder.

FIG. 4 shows a derived embodiment, still utilizing 4 valves per cylinder, but further comprising two spark plugs for each cylinder. The advantages of using twin spark plugs are well known in the art. Evidently, a direct fuel injector may easily be substituted for one of the two spark plugs.

Although the preferred embodiments of the invention are multi-valve engines, for clarity, a two-valve variant is introduced, in FIG. 5, and subsequently used throughout the description and operation sections of this application.

Besides the distinctly innovative combustion chamber arrangement, another new feature of the invention is the use of a closed-path, or desmodromic, VCS actuation mechanism.

Indeed, the device, according to the invention, uses an internal cam profile, or slot, to move the volume control slider.

The preferred slot profile is an arithmetic, or Archimedes, spiral, which gives a radial displacement directly proportional to the rotation angle, and ensures the two edges of the slot are always parallel.

The volume control slider is provided with preferably roller type cam followers, rigidly attached to the slider and riding inside the internal cam slots. Thus, the slider is mechanically constrained to follow the cam motion, in both directions. Pressure oscillations can no longer break the contact between the slider and its drive cam, as it is possible with the prior art devices. Using roller type cam followers also eliminates the risk of frictional galling at the cam to slider point of contact.

The toroidal shape of the VCS affords the use of multiple cams, to advantageously split the actuation force and reactive torque across two, or four contact points and bearings. The preferred embodiments of the invention utilize two pairs of identical cams for each VCS, with the cams positioned symmetrically about the centrally located spark plug well.

To prevent uncontrolled VCS oscillations, it is necessary to minimize the reactive torque generated by cylinder pressure acting upon the VCS. As will be explained in the following sections of this application, the device of the invention, in its preferred embodiments, does successfully address this requirement.

OBJECTS AND ADVANTAGES

Accordingly, several objects and advantages of my invention are:

The main object of the invention is to provide a practical solution for improving the part-load efficiency of the spark ignition engine, without compromising full-load performance. This translates into better fuel economy and lower greenhouse gas carbon dioxide emissions, for a given power output.

An attractive corollary is the potential for augmenting engine performance, by extending the usable boost range of a supercharged engine. Indeed, the device of the invention makes it possible to increase intake charge density, while maintaining the compression pressure, Pc, at a constant and safe level.

Although mainly targeted at spark ignition engines, the concept of the invention is also applicable to supercharged compression ignition, or Diesel, engines. The typical naturally aspirated compression ignition engine already runs unthrottled, at essentially constant compression pressure. Supercharged compression ignition engines, however, would benefit from a constant compression pressure, under varying boost pressure.

For comparison, the most frequently explored alternative solutions for improving the SI engine efficiency include Controlled Auto Ignition (CAI), also referred to as Homogenous Charge Compression Ignition (HCCI), Electric Hybrids, Variable Valve Timing (VVT), and other variable CR technologies.

Some of the advantages of the Constant Compression Engine of the invention, in general, and compared to these alternative paths, are:

Importantly, a larger engine will run at lighter loads on the same test cycle, with worse fuel economy, compared to a smaller engine. Therefore, by using a wide range variable CR solution, fuel economy improvement actually increases with engine size.

The CAI (or HCCI) process is sensitively dependent on initial conditions, requiring complex, history-driven, control of those initial conditions. Furthermore, the required lean-exhaust aftertreatment is still a complex and expensive technology.

By contrast, the Constant Compression Engine of the invention provides robust and repeatable control, open-loop stable and relying on simple angular position feedback (evidently, additional feedback signals, such as cylinder pressure, may also be utilized).

Compared now to electric hybrids, one typical and significant problem of the hybrid car is loss of peak performance under sustained high output operation, as the batteries are being depleted. Evidently, that is not the case with a variable CR engine, the device of the invention also being substantially simpler and less expensive than a hybrid configuration, and entailing no changes to the base vehicle.

Another, very serious ramification of hybrid vehicles is the unknown effect of long-term exposure to strong electromagnetic fields on human health.

Variable Valve Timing has the potential to both optimize the gas exchange process over the entire speed/load domain and to reduce pumping losses (e.g. Miller cycle engines). However, the currently available VVT systems only operate on one or two of the three valve motion parameters (lift, phasing and duration). Nevertheless, VVT may be advantageously utilized in conjunction with a variable CR system.

Referring now to other variable CR technologies, the advantages of the disclosed solution are:

The system utilizes only existing technologies, so that no fundamental research work is required. The invention provides a simple, robust configuration, easy to implement in production. In principle, no engine block modifications are required, only the pistons and cylinder head need to change.

The proposed system affords a wider CR range than any of the existing solutions, making it possible to run at a constant compression pressure, from idle to about 2 bar manifold absolute pressure.

Moreover, the moving masses of the device of the invention are substantially lesser than those of the engine block or cylinder head, the lower inertia of the moving components resulting in fast response time, positively affecting transient efficiency.

Additionally, the desmodromic drive eliminates volume control slider chatter and loss of slider-cam contact. Using a plurality of advantageously arranged identical cams offers an elegant solution to mitigate the torsional vibrations induced by the pulsating cylinder pressure.

| | |
|---|---|
| D1 | First Angular Direction |
| D2 | Second Angular Direction |
| d1 | First Linear Direction |
| d2 | Second Linear Direction |
| F | Reactive Force |
| L, L1, L2 | Moment Arms |
| M | Reactive Moment |
| R | Curve Radius |
| T | Tangency Point |
| X | Intersection Point |
| 10 | Cylinder |
| 20 | Piston |
| 30 | Intake Valve |
| 35 | Exhaust Valve |
| 40 | Cylinder Head |
| 50 | Volume Control Slider (VCS) |
| 55 | Cam Follower |
| 60 | Actuation Cam |
| 65 | Profiled Slot |

-continued

| | |
|---|---|
| 70 | Cam Carrier |
| 80 | Spark Plug |
| 85 | Spark Plug Well |
| 90 | First Seal Means |
| 95 | Second Seal Means |
| 100 | Actuator Means |

DETAILED DESCRIPTION OF THE INVENTION

Figure 1:
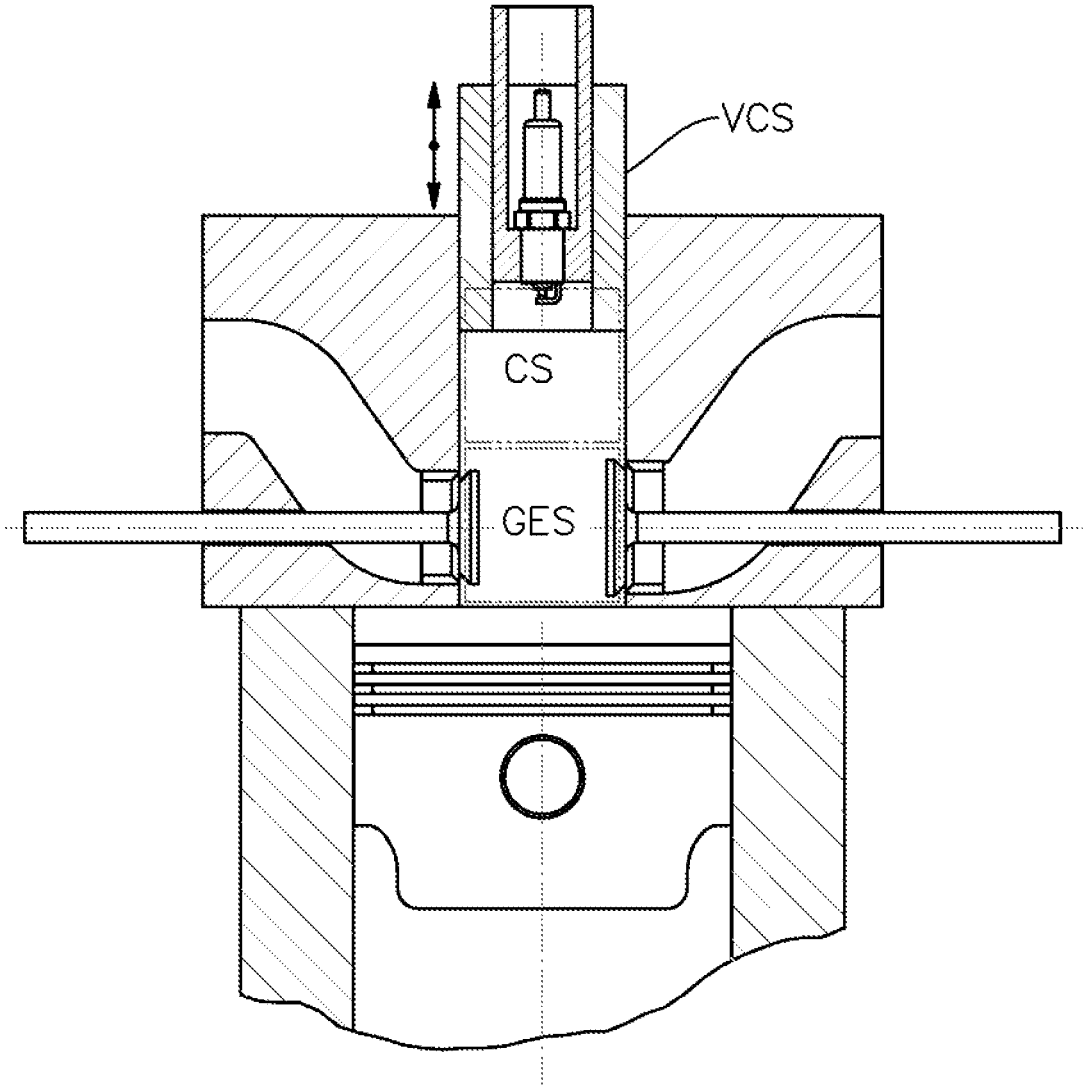
FIG. 1 illustrates the novel combustion chamber arrangement, according to the invention.
Figure 2:
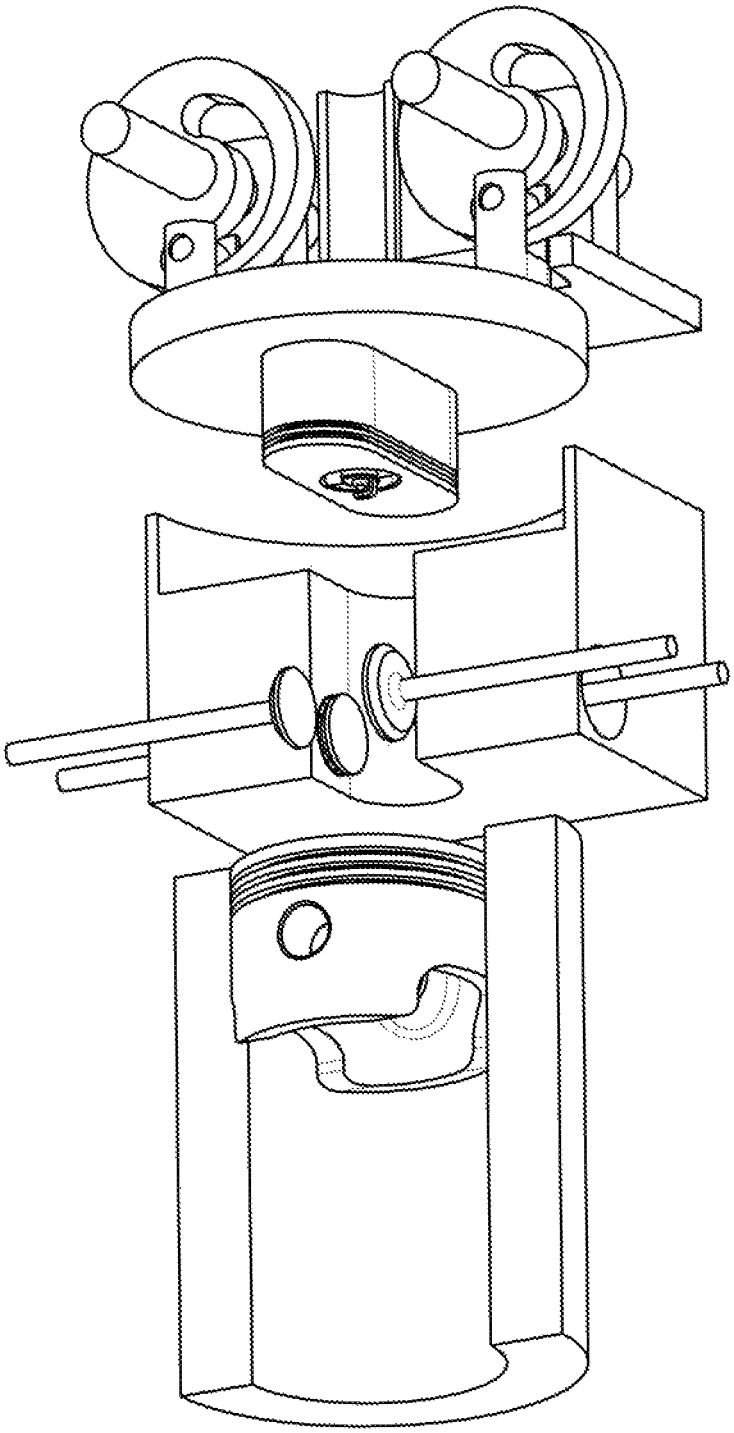
FIG. 2 is a perspective rendering of a first embodiment of the invention.
Figure 3:
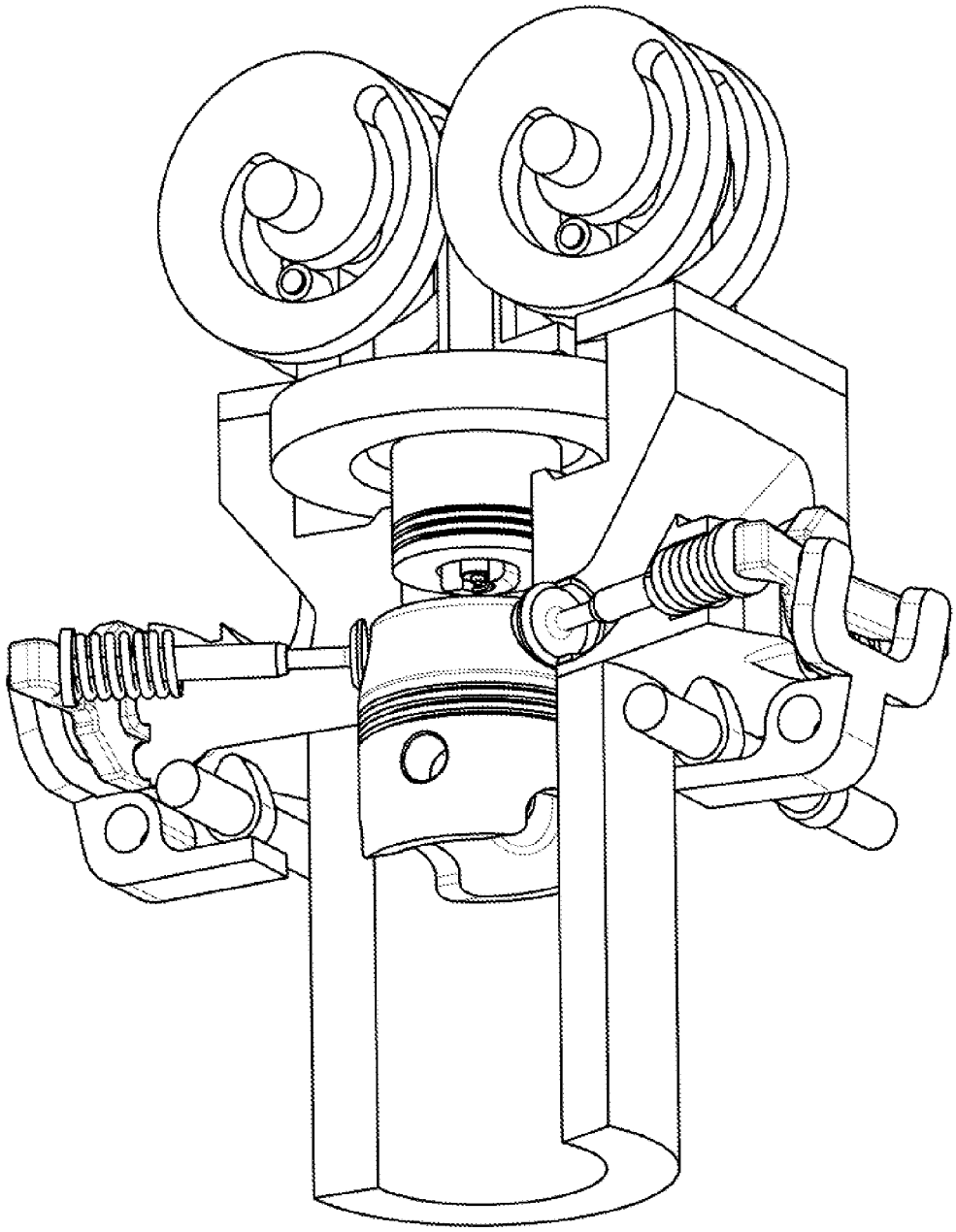
FIG. 3 is a perspective rendering of a second, preferred, embodiment of the invention.
Figure 4:
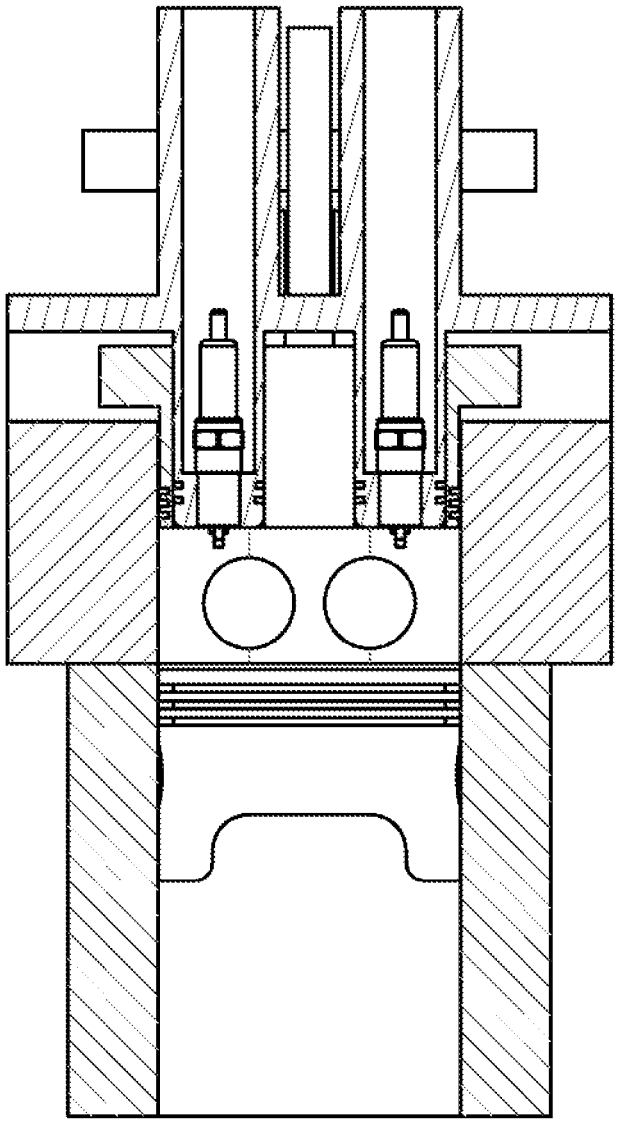
FIG. 4 shows a derived embodiment of the invention, using two spark plugs per cylinder.
Figure 5:
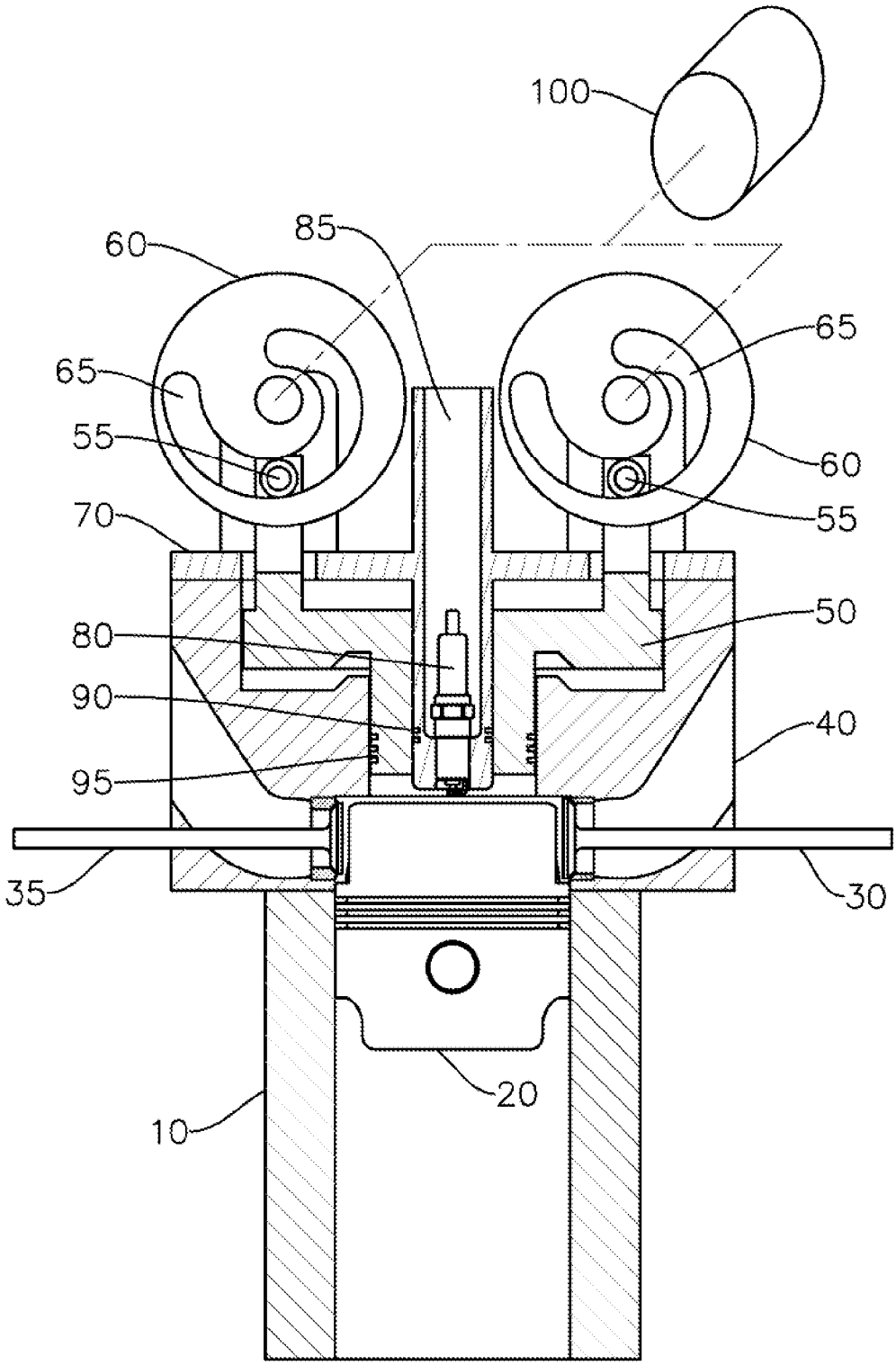
FIG. 5 introduces a simplified representation of the preferred embodiment from FIG. 3.

FIG. 5 presents the device of the invention, in an intermediate position. One cylinder of an internal combustion engine is depicted, comprising a cylinder 10, and a piston 20. For clarity and considering that the internal combustion engine operation is well known, only those engine components relevant to the invention are shown.

The engine cylinder comprises at least one intake valve 30, and one exhaust valve 35, preferably installed in a cylinder head 40. Cylinder head 40 is rigidly joined to cylinder 10, in a fashion known to those skilled in internal combustion engines design and practice.

Intake valve 30 and exhaust valve 35 are installed with their centerlines parallel to a plane substantially perpendicular to the axis of cylinder 10.

A preferably toroidal volume control slider 50, comprising at least one, substantially cylindrical, cam follower 55, is slidably mounted inside cylinder head 40. In the preferred embodiments of the invention, cam follower 55 is of the well-known roller type.

At least one actuation cam 60 is rotatably mounted on the cylinder head. The preferred embodiment of the invention utilizes two pairs of identical cams, positioned symmetrically about the cylinder centerline. Each of said at least one actuation cams has a profiled slot 65, of variable radius, cut therethrough. In the preferred embodiments of the invention, the slot is profiled along an Archimedes, or arithmetic, spiral.

Equivalently, actuation cams 60 can be rotatably mounted on a cam carrier 70, which is fixedly attached to cylinder head 40. While immaterial to the operation of the device, the presence of the cam carrier makes it easier to assemble a real-world, functional, device.

Said one cylinder of an internal combustion engine further comprises at least one spark plug 80, installed in a spark plug well 85, said spark plug well being machined either into cylinder head 40, or, equivalently, into cam carrier 70.

The device further comprises a first seal means 90 and a second seal means 95, to prevent combustion chamber pressure from leaking between the slider and spark plug well and between the slider and cylinder head, respectively.

In the preferred embodiment of the invention, seals means 90 and 95 are circular piston rings, commonly used in the art.

Each cam follower 55 is positioned inside a corresponding slot, in the usual slot/follower arrangement, whereby it can freely follow the profile of the slot. The diameter of cam follower 55 is lesser than the width of the profiled slot, by only a substantially small amount, to ensure almost zero play in the slot/follower joint.

The device further comprises an actuator means 100, capable to drive said at least one actuation cam in a rotary motion and to hold a predetermined angular position against a reactive torque. As the cam rotates, cam follower 55 moves along the variable-radius slot profile, thereby driving volume control slider 60 in a linear motion. It should be understood that, in the case of those embodiments using a plurality of identical cams, actuator 100 drives said plurality of identical cams simultaneously.

Operation

Figure 6A:
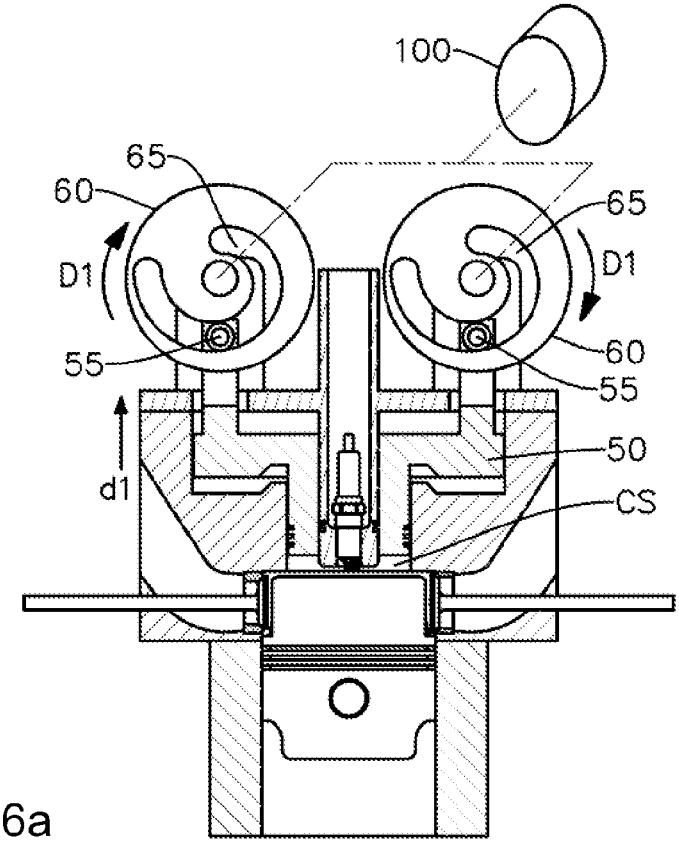
FIG. 6*a* illustrates the operation of the device of the invention, during increasing engine load.

Referring now to FIG. 6*a*, as engine load increases, actuator means 100 drives actuation cams 60 in a first angular direction, D1. Cam followers 55 are urged to move along profiled slots 65, thereby driving volume control slider 50 in a linear motion, along a first linear direction d1.

The slot radius decreases as the cam turns in the direction D1, therefore the slider motion in the direction d1 causes the CS volume to increase, effectively reducing the geometric compression ratio of the engine.

Figure 6B:
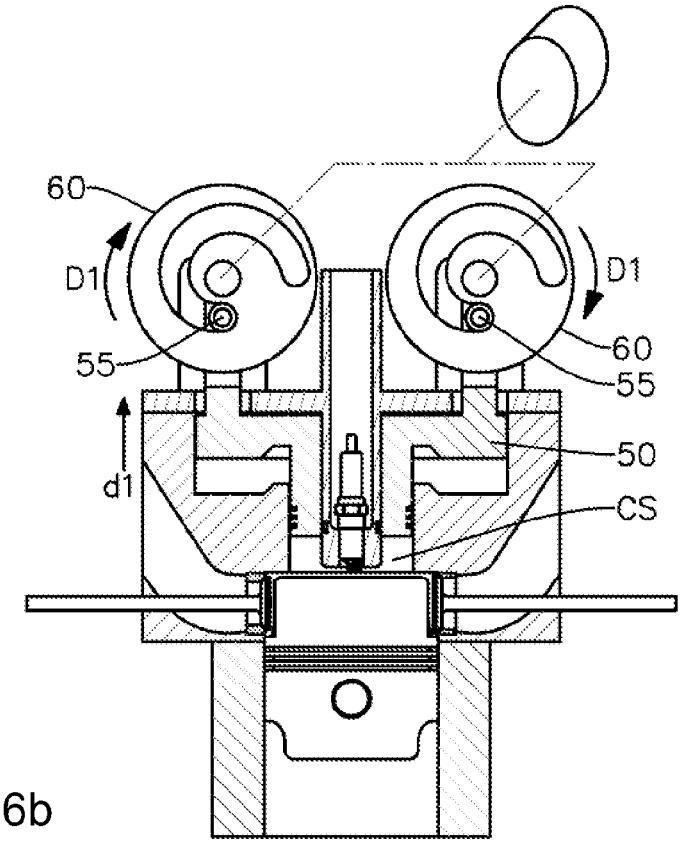
FIG. 6*b* is a schematic representation of a preferred embodiment of the invention, shown in its position corresponding to the lowest geometrical compression ratio of the engine.

FIG. 6*b* shows actuation cams 60 fully rotated in the direction D1, whereby cam followers 55 have reached a first end of the profiled slots. Volume control slider 50 is now in a first limit position, corresponding to maximum CS volume, and subsequently, minimum geometric compression ratio.

Figure 7A:
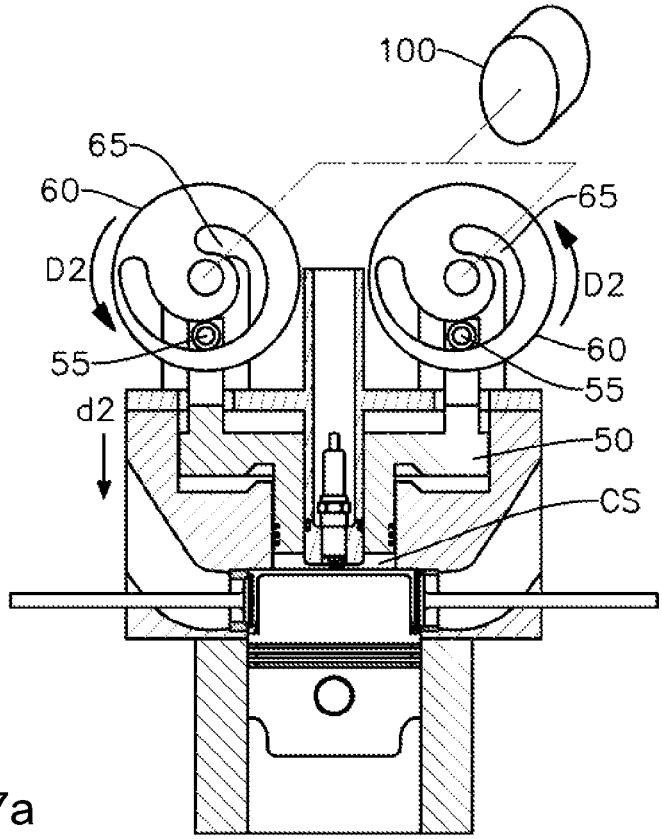
FIG. 7*a* depicts the operation of the device of the invention, during decreasing engine load.

Referring now to FIG. 7*a*, as engine load decreases, actuator means 100 drives actuation cams 60 in a second angular direction D2, opposite to first angular direction D1. Cam followers 55 are urged in motion, along profiled slots 65, thereby moving volume control slider 50 linearly, in a second linear direction d2, substantially opposite said first linear direction d1.

The slot radius increases as the cam turns in the direction D2. Hence, the volume control slider motion in the direction d2 causes the CS volume to decrease, effectively raising the geometric compression ratio of the engine.

Figure 7B:
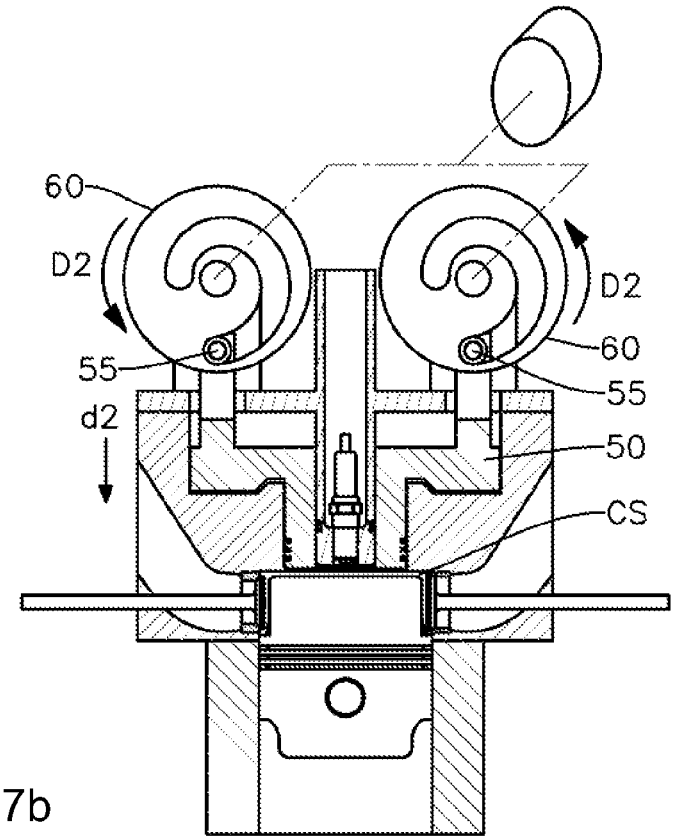
FIG. 7*b* is a schematic representation of a preferred embodiment of the invention, shown in its position corresponding to the highest geometrical compression ratio of the engine.

FIG. 7*b* shows actuation cams 60 fully rotated in the direction D2, whereby each cam follower 55 has reached a second end of the profiled slot. Volume control slider 50 is now in a second limit position, corresponding to minimum CS volume, and subsequently, maximum geometric compression ratio.

It is understood, by those skilled in the art, that the actuation cam law of motion obeys a predetermined relationship to engine load, said predetermined relationship being established according to a mathematical model of the engine, or based on empirical tables, and using information from a set of appropriate sensors.

FIG. 8*a* through 8*d* illustrate how the cam profile is advantageously used to mitigate the torsional vibrations of the actuation camshaft.

Figure 8A:
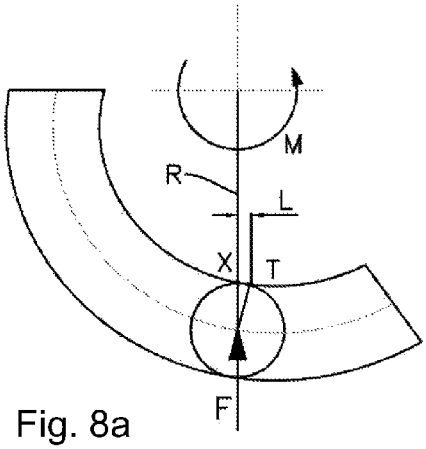
FIG. 8*a* describes the geometry of the reactive torque generated by cylinder pressure.

As schematically shown in FIG. 8*a*, cylinder pressure generates a reactive force F, acting upon the VCS, in a direction substantially parallel to the axis of translation of said VCS. Since the cam slot is profiled along a variable-radius curve, and the follower centerline is necessarily coplanar with the axis of gyration of the cam, the cam-to-follower contact point will be offset from a curve radius R passing through the follower centerline, thereby creating a reactive torque—or rotational moment—M, which tends to rotate the cam in the direction shown.

The arm L of rotational moment M is equal to the distance between the cam/follower tangency point T and the intersection point X, of the profile curve with curve radius R. Thus the moment arm would only be zero if the curve were a circle. To minimize torsional vibrations in the actuation camshaft, the reactive torque should be reduced as much as possible.

Figure 8B:
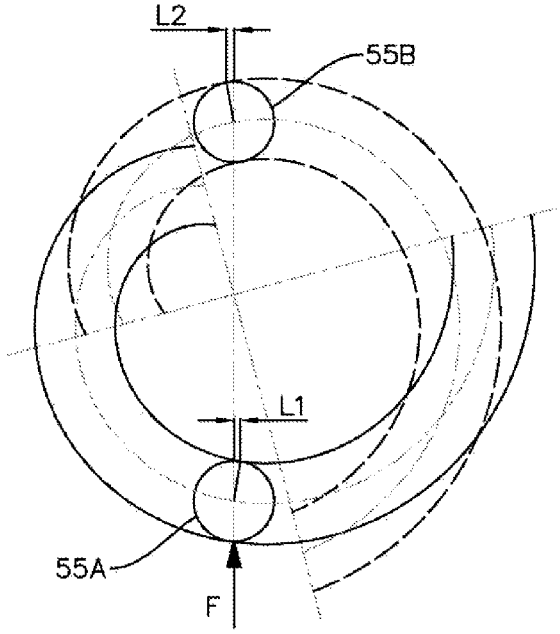
FIG. 8*b* graphically describes the preferred volume control slider interface to the actuation cams.

An effective means for reducing the reactive torque is to use a cam pair, comprising a first cam and a second cam, the geometry of which is illustrated in FIG. 8*b*. The second cam profile (dashed line in FIG. 8*b*) is the mirror image of the first cam profile (solid line in FIG. 8*b*), and its starting point is offset by an angle equal to the total curve angle (in this case, and purely for illustrative purposes, that angle is equal to 270)°.

Still referring to FIG. 8*b*, the VCS associated with the described cam pair utilizes two separate cam followers, a first cam follower 55A, riding along the first cam slot, and a second cam follower 55B, engaged into the profiled slot of the second cam of the pair. The two cam followers lie on an axis substantially parallel to the direction of application of reactive force F.

It is apparent that reactive force F always pushes cam follower 55A against the inner curve of the first profile, towards the center of the spiral, while urging cam follower 55B against the outer curve of the second profile, away from the center. Thus, the moment arms, L1 and L2, on the two cams of a pair, fall on the opposite sides of a plane containing the follower centerlines and the cam axis of gyration.

That does not completely cancel out the rotational moments acting on the two cams of a pair, but it does substantially reduce the resultant moment.

In order to keep both followers in permanent contact with both edges of the two slots, the inner and outer curves of each slot must be always parallel. The slot profile must also be rotationally symmetrical, i.e. provide the same radial displacement, for the same angle, irrespective of the angle origin. These requirements are met by using parallel and equal-slope arithmetic spirals, on all slot edges.

While the corresponding curves on the two cams must be defined by numerically identical equations, they do not necessarily have to be of equal length. However, it is evidently advantageous to utilize two cams of identical profile, arranged as described in the preceding paragraph.

Figure 8C:
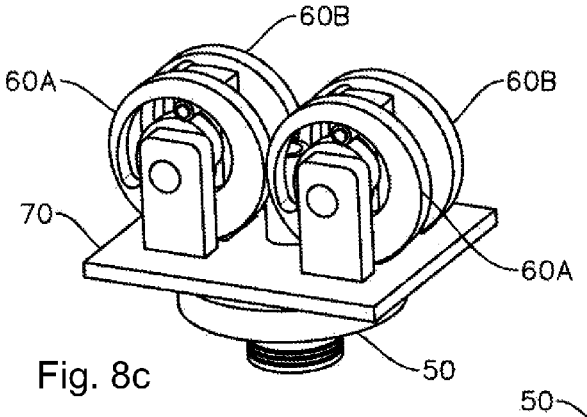
FIG. 8*c* presents the preferred actuation cams arrangement, for reactive torque reduction.

FIG. 8*c* exemplifies a practical implementation of the geometry described above: two pairs of identical cams, 60A and 60B are rotatably mounted in a cam carrier 70. All four cams drive the VCS simultaneously, and the slots of the two cams of a pair are arranged as described in FIG. 8*b*.

Figure 8D:
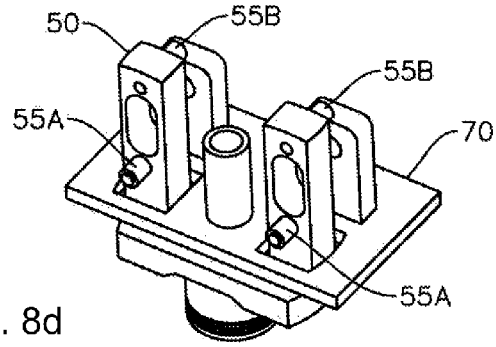
FIG. 8*d* shows additional details of the reactive torque reduction solution.

FIG. 8*d* is a cross section through both VCS 50 and cam carrier 70, illustrating the physical distribution of the VCS cam followers. For clarity, the cams have been removed, to offer an unobstructed view of the two pairs of followers, each pair consisting of a first cam follower 55A and a second cam follower 55B.

CONCLUSION, RAMIFICATIONS AND SCOPE

Thus the reader will see that the device of the invention provides a simple, yet effective means to regulate the compression pressure of an internal combustion engine, by advantageously manipulating the geometric compression ratio of said internal compression engine.

The proposed device will provide a valuable shortcut to significant fuel economy improvements, relying solely on established technologies, especially on proven stoichiometric operation and aftertreatment.

Moreover, the solution herein disclosed will also permit a high re-usability rate of current control and tuning experience and techniques.

It is worth noting that direct injection would further improve fuel economy, by eliminating fuel waste during valve overlap. The most compact direct injection packaging would be accomplished by utilizing an integrated injector/spark plug unit. Some patented integrations do exist, e.g. U.S. Pat. No. 5,497,744 (Toyota), U.S. Pat. No. 6,536,405 and U.S. Pat. No. 6,871,630 (Bosch), U.S. Pat. No. 6,955,154 (Douglas).

Best overall architecture would likely include TWC, Direct Injection, VVT and Variable Turbine Geometry turbochargers, all of which are existing technologies.

Accordingly, the scope of the invention should be determined not by the embodiment illustrated, but by the appended claims and their legal equivalents.

I claim:

1. A cam actuation mechanism comprising in combination:

(a) at least one pair of preferably identical cams, comprising a first and a second cam, each cam comprising a curvilinear slot, said curvilinear slot being bounded by an inner surface, defined by an inner variable-radius curve, and by an outer surface, substantially parallel to said inner surface and defined by an outer variable-radius curve, each variable-radius curve being rotationally symmetric, whereby the absolute rate of change in radius length, over an arbitrary curve angle, is the same, irrespective of the origin and direction of said arbitrary curve angle, (b) coupling means, including a shaft, for providing a torsionally rigid joint between the two cams of a pair, wherein the cams are coaxially mounted to said coupling means, (c) a driven member, capable of moving linearly along an axis substantially perpendicular to the axis of rotation of the cams, (d) at least one pair of substantially cylindrical slot followers, rigidly attached to said driven member, comprising a first and a second slot follower, whereby said first slot follower is captively engaged into said curvilinear slot of the first cam and said second slot follower is captively engaged into said curvilinear slot of the second cam, and (e) actuator means for simultaneously rotating the two cams of a pair to a predetermined angular position, thereby urging said driven member to a linear position, determined by the geometrical profile of the variable-radius curves defining the curvilinear slots.

2. The cam actuation mechanism of claim 1 wherein said inner variable-radius curve and said outer variable-radius curve are Archimedean spirals.

3. The cam actuation mechanism of claim 1 wherein:

(a) an external force acts upon said driven member, along a direction substantially parallel to the direction of translation of said driven member, whereby said external force imparts a rotational moment to each cam, (b) the centerlines of the cylindrical slot followers are substantially perpendicular to the direction of application of said external force, said centerlines being coplanar with the common axis of gyration of said preferably identical cams, wherein said axis of gyration falls between the centerlines of the slot followers, thereby causing the external force to act upon said inner surface of said curvilinear slot of one cam and upon said outer surface of said curvilinear slot of the other cam of the pair, (c) said pair of preferably identical cams are oriented in a predetermined reciprocal position, whereby jointly rotating the cams causes the mean radius of said curvilinear slot of the first cam and the mean radius of said curvilinear slot of the second cam to vary in opposite directions, (d) whereby the point of application of said external force to said first cam falls on a first side of a median plane containing, in combination, said common axis of gyration, the centerline of said first slot follower and the centerline of said second slot follower, and (e) whereby the point of application of said external force to said second cam falls on a second side of said median plane, substantially opposite said first side of said median plane, thereby imparting rotational moments of opposite directions to the two cams of a pair.

4. An internal-combustion engine comprising the cam actuation mechanism of claim 1, said internal-combustion engine further comprising a combustion chamber wherein:

(a) the linearly-moving driven member of said cam actuation mechanism projects into said combustion chamber, (b) thereby effectively altering the volume of said combustion chamber, when driven in a linear motion by the cams.

* * * * *